US009183979B2

(12) United States Patent
Cha et al.

(10) Patent No.: US 9,183,979 B2
(45) Date of Patent: Nov. 10, 2015

(54) CHIP INDUCTOR AND METHOD FOR MANUFACTURING THE SAME

(71) Applicant: SAMSUNG ELECTRO-MECHANICS CO., LTD., Gyeonggi-do (KR)

(72) Inventors: Hye Yeon Cha, Gyeonggi-do (KR); Kang Heon Hur, Gyeonggi-do (KR); Sung Jin Park, Busan (KR); Dong Jin Jeong, Busan (KR); Jung Min Park, Gyeonggi-do (KR); Hyeog Soo Shin, Busan (KR); Sung Yong An, Gyeonggi-do (KR); Hwan Soo Lee, Seoul (KR); Young Do Kweon, Seoul (KR); Jin Woo Hahn, Gyeonggi-do (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 54 days.

(21) Appl. No.: 13/725,478

(22) Filed: Dec. 21, 2012

(65) Prior Publication Data

US 2013/0162382 A1 Jun. 27, 2013

(30) Foreign Application Priority Data

Dec. 22, 2011 (KR) ..... 10-2011-0140409

(51) Int. Cl.

| | |
|---|---|
| ***H01F 5/00*** | (2006.01) |
| ***H01F 27/29*** | (2006.01) |
| ***H01F 41/04*** | (2006.01) |
| ***H01F 17/00*** | (2006.01) |

(52) U.S. Cl.

CPC ..... *H01F 27/29* (2013.01); *H01F 5/00* (2013.01); *H01F 17/0033* (2013.01); *H01F 41/041* (2013.01); *H01F 41/046* (2013.01); *H01F 27/292* (2013.01); *Y10T 29/4902* (2015.01)

(58) Field of Classification Search

CPC ..... H01F 5/00; H01F 27/00–27/30
USPC ..... 336/65, 83, 90, 96, 200, 232
See application file for complete search history.

(56) References Cited

U.S. PATENT DOCUMENTS

| | | | | |
|---|---|---|---|---|
| 6,825,746 | B2 * | 11/2004 | Otsuka et al. | 336/83 |
| 6,956,455 | B2 * | 10/2005 | Tokuda et al. | 336/83 |
| 7,212,094 | B2 * | 5/2007 | Matsutani et al. | 336/200 |
| 7,477,127 | B2 * | 1/2009 | Kamijima | 336/206 |
| 7,495,538 | B2 * | 2/2009 | Tsunemi et al. | 336/84 M |
| 7,663,464 | B2 * | 2/2010 | Yamamoto et al. | 336/205 |
| 7,859,377 | B2 * | 12/2010 | Kawarai | 336/83 |
| 8,284,005 | B2 * | 10/2012 | Yamamoto et al. | 336/83 |

FOREIGN PATENT DOCUMENTS

| | | | |
|---|---|---|---|
| JP | 09007838 A | * | 1/1997 |
| KR | 10-0805275 | * | 2/2008 |

* cited by examiner

*Primary Examiner* — Tuyen Nguyen
(74) *Attorney, Agent, or Firm* — McDermott Will & Emery LLP

(57) ABSTRACT

The present invention relates to a chip inductor including: a metal-polymer composite in which metal particles and polymer are mixed; a wiring pattern provided inside the metal-polymer composite to form a coil; an external electrode provided in a portion of an outer peripheral surface of the metal-polymer composite; and an insulating portion provided between the metal-polymer composite and the wiring pattern and between the metal-polymer composite and the external electrode, and a method for manufacturing the same.

12 Claims, 6 Drawing Sheets

CHIP INDUCTOR AND METHOD FOR MANUFACTURING THE SAME

CROSS-REFERENCE TO RELATED APPLICATIONS

Claim and incorporate by reference domestic priority application and foreign priority application as follows:

CROSS REFERENCE TO RELATED APPLICATION

This application claims the benefit under 35 U.S.C. Section 119 of Korean Patent Application Serial No. 10-2011-0140409, entitled filed Dec. 22, 2011, which is hereby incorporated by reference in its entirety into this application.

BACKGROUND OF THE INVENTION

1. Field of the Invention

The present invention relates to a chip inductor and a method for manufacturing the same, and more particularly, to a chip inductor capable of removing noises by being provided in IT devices, and a method for manufacturing the same.

2. Description of the Related Art

In recent times, miniaturization and thinning of IT devices such as various communication devices or display devices have been accelerated, and researches for miniaturization and thinning of various devices employed in these IT devices, such as inductors, capacitors, and transistors, also have been continuously carried out.

Among these devices, a chip inductor has been widely used to remove noises generated from IT devices. A conventional chip inductor could be mass-produced by laminating a plurality of layers, each of which is formed by forming a wiring pattern on a magnetic sheet, pressing the laminate in a high temperature environment to sinter the laminate, and connecting wiring of each layer through a via hole.

In Patent Document 1, a technology related to the above-described multilayer chip inductor is disclosed.

Meanwhile, a demand for inductors with a high allowable current value has been increased according to high performance of IT devices such as smartphones and tablet PCs. Accordingly, efforts to develop inductors that have improved DC bias characteristics as well as implementing high inductance and low DC resistance characteristics have been continuously made.

However, in the conventional inductor as disclosed in the Patent Document 1, since the wiring pattern is formed on the magnetic sheet, there is a need for wiring spacing above a predetermined level due to limitations in securing insulation and processing.

Further, DC resistance of the wiring pattern is increased when a cross section of the wiring pattern is reduced.

Therefore, the conventional inductor had limits to the number of windings formed on one layer and miniaturization and thinning since the number of layers on which the wiring patterns are formed should be increased in order to implement high inductance.

In addition, in the conventional inductors, magnetic saturation occurred due to a limitation on a material that implements a magnetic substance, and this magnetic saturation was an obstacle to improvement of characteristics of the inductor.

RELATED ART DOCUMENT

Patent Document

Patent Document 1: Japan Patent Laid-open Publication No. 2005-109097

SUMMARY OF THE INVENTION

The present invention has been invented in order to overcome the above-described problems and it is, therefore, an object of the present invention to provide a chip inductor capable of being miniaturized and thin in a mass-production manner as well as having improved characteristics by overcoming magnetic saturation, and a method for manufacturing the same.

In accordance with one aspect of the present invention to achieve the object, there is provided a chip inductor including: a metal-polymer composite in which metal particles and polymer are mixed; a wiring pattern provided inside the metal-polymer composite to form a coil; an external electrode provided in a portion of an outer peripheral surface of the metal-polymer composite; and an insulating portion provided between the metal-polymer composite and the wiring pattern and between the metal-polymer composite and the external electrode.

At this time, the polymer may include at least one material selected from epoxy, polyimide, and liquid crystal polymer (LCP).

Further, the metal particles may include iron (Fe).

At this time, it is preferred that a diameter of the metal particles is in the range of several hundreds of nm to several tens of μm.

Further, the wiring pattern may be formed of a plurality of layers, and the wiring pattern may be formed by performing winding at least twice on one layer.

In accordance with another aspect of the present invention to achieve the object, there is provided a chip inductor including: a base substrate; a wiring pattern provided on an upper surface of the base substrate to form a coil; a metal-polymer composite provided on the upper surface of the base substrate and formed by mixing metal particles and polymer; an external electrode provided in portions of outer peripheral surfaces of the base substrate and the metal-polymer composite; and an insulating portion provided between the metal-polymer composite and the wiring pattern and between the metal-polymer composite and the external electrode.

In accordance with still another aspect of the present invention to achieve the object, there is provided a method for manufacturing a chip inductor including the steps of: forming a wiring pattern on a surface of a base substrate; forming an insulating layer to cover the wiring pattern and the surface of the base substrate; forming an insulating portion by removing a region of the insulating layer except the region in which the wiring pattern is formed; and filling a metal-polymer composite in the region except the insulating portion.

At this time, the step of forming the wiring pattern on the surface of the base substrate may be performed by printing or plating.

Further, the step of forming the insulating portion by removing the region of the insulating layer except the region in which the wiring pattern is formed may remove the uncured region after exposing through a mask, which exposes the region in which the wiring pattern is formed, to cure the exposed region.

Further, the step of forming the insulating portion by removing the region of the insulating layer except the region in which the wiring pattern is formed may remove the region of the insulating layer except the region in which the wiring pattern is formed after exposing through a mask which exposes the region except the region in which the wiring pattern is formed.

Further, the method for manufacturing a chip inductor may further include, after the step of filling the metal-polymer composite, the steps of: forming a via hole by removing a portion of the insulating portion to expose an upper surface of the wiring pattern; forming a second wiring pattern on an upper surface of the insulating portion; forming a second insulating layer to cover the second wiring pattern and a surface of the metal-polymer composite; forming a second insulating portion by removing a region of the second insulating layer except the region in which the wiring pattern is formed; and filling a metal-polymer composite in the region except the second insulating portion.

Further, the step of forming the insulating portion by removing the region of the insulating layer except the region in which the wiring pattern is formed includes a process of forming a via hole to expose an upper surface of a portion of the wiring pattern, and the method for manufacturing a chip inductor may further include, after the step of filling the metal-polymer composite, the steps of: forming a second wiring pattern on an upper surface of the insulating portion; forming a second insulating layer to cover the second wiring pattern and a surface of the metal-polymer composite; forming a second insulating portion by removing a region of the second insulating layer except the region in which the wiring pattern is formed; and filling a metal-polymer composite in the region except the second insulating portion.

At this time, the step of forming the insulating portion by removing the region of the insulating layer except the region in which the wiring pattern is formed may remove the uncured region after exposing through a mask, which exposes the region in which the wiring pattern is formed except the region in which the via hole is to be formed, to cure the exposed region.

Further, the step of forming the insulating portion by removing the region of the insulating layer except the region in which the wiring pattern is formed may remove the region of the insulating layer except the region in which the wiring pattern is formed after exposing through a mask which exposes the region in which the wiring pattern is formed and the region in which the via hole is to be formed.

In accordance with still another aspect of the present invention to achieve the object, there is provided a method for manufacturing a chip inductor including the steps of: forming a first wiring pattern on a surface of a base substrate; forming a first insulating layer to cover the first wiring pattern and the surface of the base substrate; forming a via hole by removing a portion of the first insulating layer to expose an upper surface of a portion of the first wiring pattern; forming a second wiring pattern on the first insulating layer; forming a second insulating layer to cover the second wiring pattern and a surface of the second insulating layer; forming an insulating portion by removing regions of the first insulating layer and the second insulating layer except the regions in which the wiring patterns are formed; and filling a metal-polymer composite in the region except the insulating portion.

At this time, the metal-polymer composite may include at least one material selected from epoxy, polyimide, and liquid crystal polymer (LCP).

Further, the metal-polymer composite may include iron (Fe).

Further, it is preferred that a diameter of metal particles is in the range of several hundreds of nm to several tens of μm.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

Figure 1:
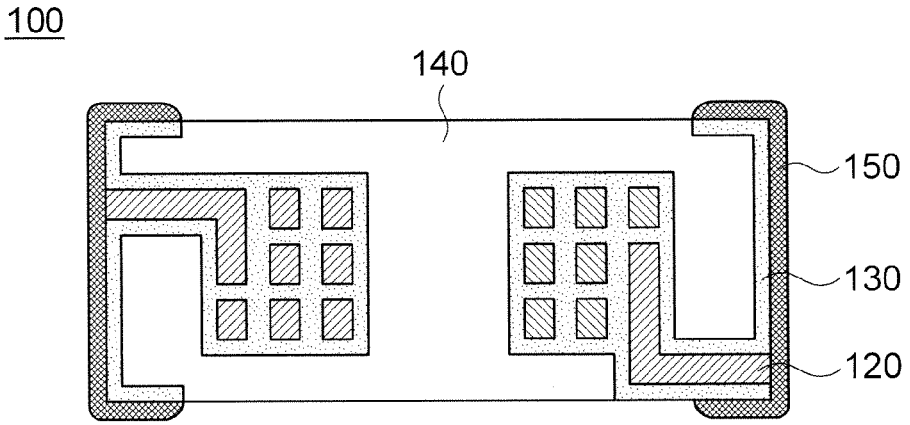
FIG. 1 is a cross-sectional view schematically showing a chip inductor in accordance with an embodiment of the present invention.

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art. Like reference numerals refer to like elements throughout the specification.

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Hereinafter, configurations and operational effects of the present invention will be described in detail with reference to the accompanying drawings.

FIG. 1 is a cross-sectional view schematically showing a chip inductor 100 in accordance with an embodiment of the present invention.

Referring to FIG. 1, a chip inductor 100 in accordance with an embodiment of the present invention may include a metal-polymer composite 140, a wiring pattern 120, an external electrode 150, and an insulating portion 130.

First, the metal-polymer composite 140 is a mixture of metal particles and polymer and provided in the chip inductor 100 instead of a conventional magnetic substance.

At this time, the metal particles may be iron (Fe), and it is preferred that a diameter of the metal particles is in the range of several hundreds of nm to several tens of μm.

Further, the polymer may be epoxy, polyimide, liquid crystal polymer (LCP), and so on.

The chip inductor 100 in accordance with an embodiment of the present invention includes the metal-polymer composite 140 instead of a magnetic substance to improve magnetic saturation characteristics.

Next, the wiring pattern 120 is made of a conductive material and connected to the external electrode 150 to become a moving path of electrons.

At this time, the wiring pattern 120 may consist of a plurality of layers, and winding is performed more than twice on one layer.

As described in the description of the problems of the prior art, there was a limitation in reducing a width of the chip inductor 100 when implementing winding more than twice on one layer because of limitations due to securing of insulation and DC resistance characteristics and magnetic saturation. The present invention invented in order to overcome this problem includes the metal-polymer composite 140 and the insulating portion 130 to wind the wiring pattern 120 at closer intervals than before.

Accordingly, when assuming that the widths of the chip inductors 100 are the same, the wiring pattern 120 in accordance with an embodiment of the present invention can secure more number of windings while having a wider width than a wiring pattern 120 of a conventional chip inductor 100.

Meanwhile, as the wiring pattern 120 is formed of a plurality of layers, the wiring pattern 120 of one layer may be electrically connected to the wiring pattern 120 of another layer through a via and form a coil shape electrically connected between the external electrodes 150, for example, a (+) electrode and a (−) electrode.

Next, the insulating portion 130 plays a role of securing insulation by being provided between the metal-polymer composite 140 and the external electrode 150 and between the metal-polymer composite 140 and the wiring pattern 120.

The chip inductor 100 in accordance with an embodiment of the present invention includes the metal-polymer composite 140 instead of a conventional magnetic substance, and at this time, since a current can flow by the metal particles constituting the metal-polymer composite 140, the insulating portion 130 should be provided.

At this time, in order to secure insulation as well as miniaturization of the chip inductor 100, it is preferred that the insulating portion 130 is formed with a thickness of several μm to several hundreds of μm from outer surfaces of conductors exposed to the metal-polymer composite 140, such as the wiring pattern 120 and the external electrode 150.

Figure 2:
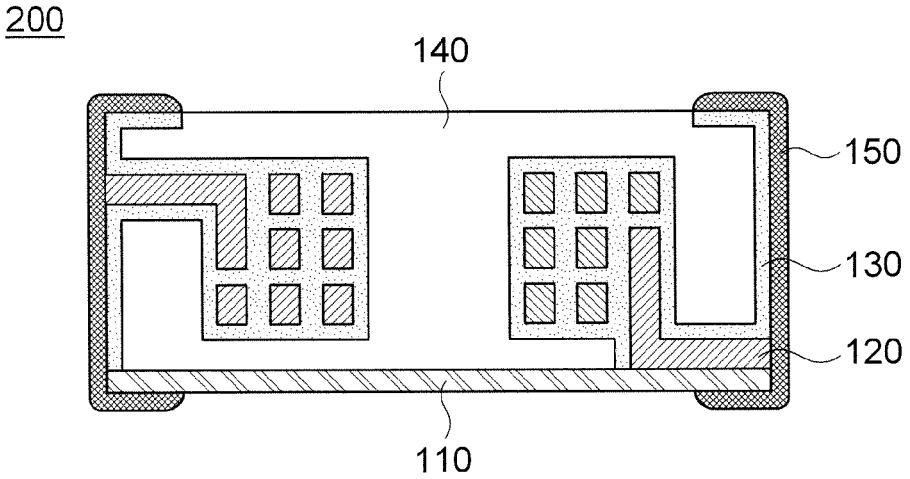
FIG. 2 is a cross-sectional view schematically showing a chip inductor in accordance with another embodiment of the present invention.

FIG. 2 is a cross-sectional view schematically showing a chip inductor 200 in accordance with another embodiment of the present invention.

Referring to FIG. 2, a chip inductor 200 in accordance with another embodiment of the present invention may include a base substrate 110, a wiring pattern 120, a metal-polymer composite 140, an external electrode 150, and an insulating portion 130.

The chip inductor 200 in accordance with another embodiment of the present invention may be implemented by applying a photoresist method instead of conventional laminating and sintering processes.

When applying a photoresist method like this, the chip inductor 100 and 200 can be implemented by sequentially forming the wiring pattern 120, the insulating portion 130, and the metal-polymer composite 140 on the base substrate 110. At this time, the chip inductor 100 can be implemented by separately providing a lower electrode for connecting the wiring pattern 120 and the external electrode 150 after removing the base substrate 110 or the chip inductor 200 can include the base substrate 110 without removing the base substrate 110 by forming a lower electrode first on the base substrate 110 by a photoresist method.

Meanwhile, when implementing the chip inductor 100 by removing the base substrate 110, a predetermined release layer may be provided between the base substrate 110 and a lowermost layer of the chip inductor 100.

Figure 3:
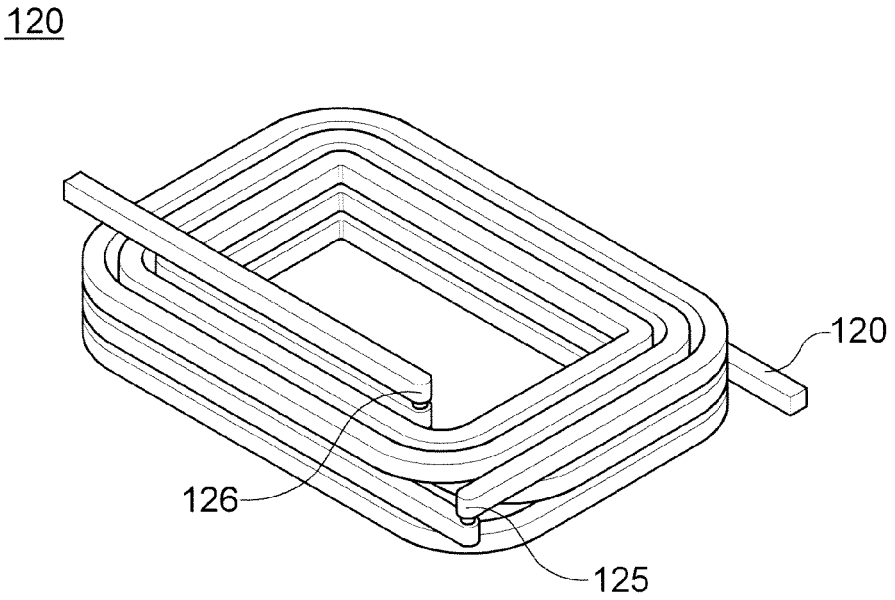
FIG. 3 is a perspective view schematically showing a wiring pattern in accordance with an embodiment of the present invention.

FIG. 3 is a perspective view schematically showing the wiring pattern 120 in accordance with an embodiment of the present invention.

Referring to FIG. 3, it is possible to understand that the wiring pattern 120 consists of three layers and the number of windings of each layer is 3. Further, at this time, the wiring pattern 120 of each layer can be connected by vias 125 and 126.

FIGS. 4*a* to 4*k* are process diagrams schematically showing a method for manufacturing a chip inductor 100 and 200 in accordance with an embodiment of the present invention.

Hereinafter, a method for manufacturing a chip inductor 100 and 200 in accordance with an embodiment of the present invention will be described in detail with reference to FIG. 4.

A method for manufacturing a chip inductor 100 and 200 in accordance with an embodiment of the present invention can be summarized in three processes: forming a wiring pattern 120, forming an insulating portion 130, and filling a metal-polymer composite 140. Of course, after that, the chip inductor 100 and 200 can be manufactured by being cut into an appropriate size and coupling an external electrode 150. Further, the wiring pattern 120 may be implemented in a plurality of layers by repeating the processes of forming the wiring pattern 120, forming the insulating portion 130, and filling the metal-polymer composite 140.

Figure 4A:
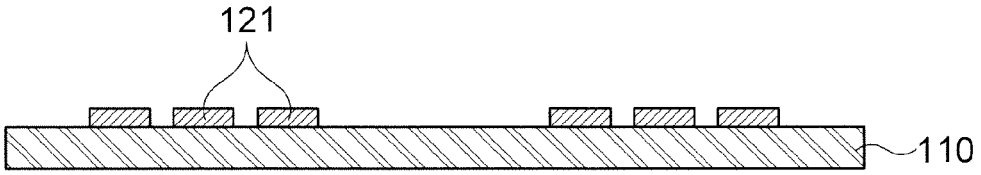
FIGS. 4*a* to 4*k* are process diagrams schematically showing a method for manufacturing a chip inductor in accordance with an embodiment of the present invention.

First, referring to FIG. 4*a*, the process of forming the wiring pattern 120 is performed by forming a first wiring pattern 121 on one surface of a base substrate 110. At this time, the first wiring pattern 121 may be formed by printing or plating.

Figure 4B:
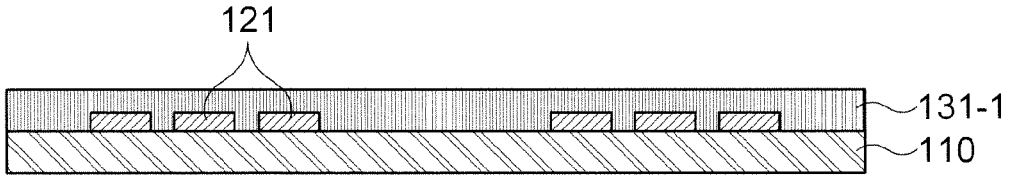

Next, as shown in FIG. 4*b*, a first insulating layer 131-1 is formed. The first insulating layer 131-1 may be formed by coating an insulating material on the base substrate 110 on which the first wiring pattern 121 is formed.

Figure 4C:
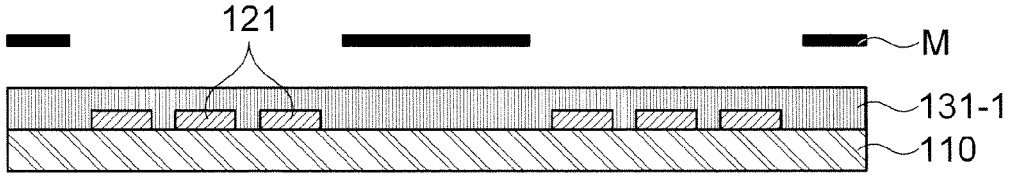

Next, as shown in FIG. 4*c*, a portion in which a first insulating portion 131 is to be formed is exposed to light through a mask M.

At this time, the mask M may be a glass mask or a film mask, and the first insulating layer 131-1 should use negative photosensitive polymer as an insulating material.

Figure 4D:
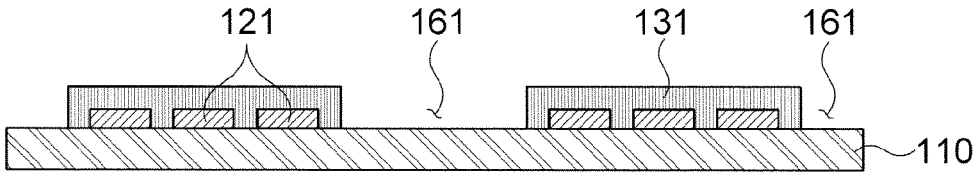

Next, as shown in FIG. 4*d*, the portion exposed to light is cured, and a portion unexposed to light is uncured. The first insulating portion 131 is formed by removing the uncured portion.

Meanwhile, although FIG. 4*c* shows the case in which the negative photosensitive polymer is used as an insulating material, the insulating layer may be implemented by positive photosensitive polymer, and in this case, a mask, which exposes the remaining region except the portion in which the first insulating portion is to be formed to light, may be used.

Figure 4E:
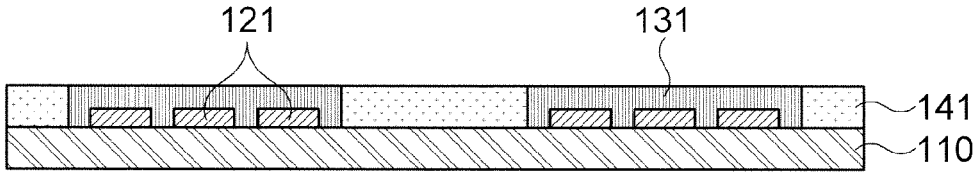

Next, as shown in FIG. 4*e*, a first metal-polymer composite 141 is filled in the region 161 from which the first insulating layer 131-1 is removed through exposure and developing processes.

Figure 4F:
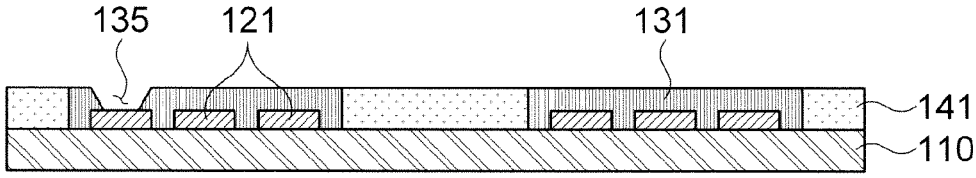

Next, as shown in FIG. 4*f*, a via hole 135 is formed in the first insulating portion 131. At this time, the via hole 135 may be formed by various methods such as an etching method using $CO_2$ laser.

Figure 4G:
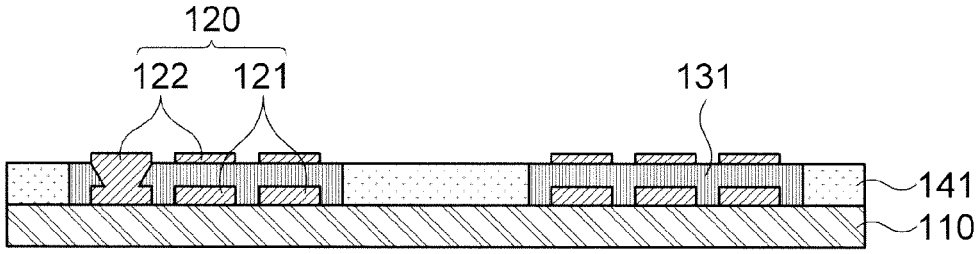

Next, as shown in FIG. 4*g*, a second wiring pattern 122 is formed on an upper surface of the first insulating portion 131. At this time, the first wiring pattern 121 and the second wiring pattern 122 can be electrically connected by filling a conductive material for forming the second wiring pattern 122 in the via hole 135 formed in the insulating portion 130.

Figure 4H:
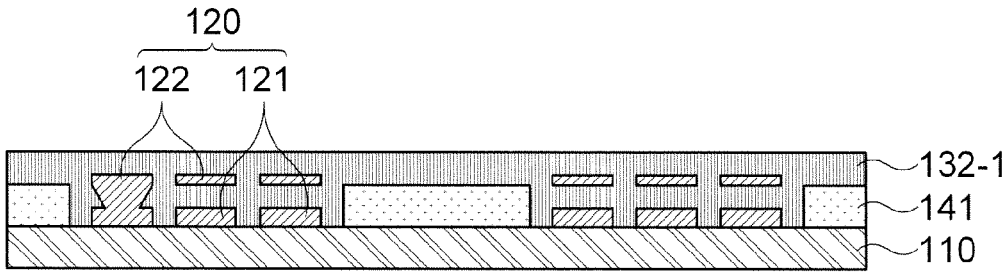

Next, as shown in FIG. 4*h*, a second insulating layer 132-1 is formed to cover surfaces of the second wiring pattern 122 and the first metal-polymer composite 141.

Figure 4I:
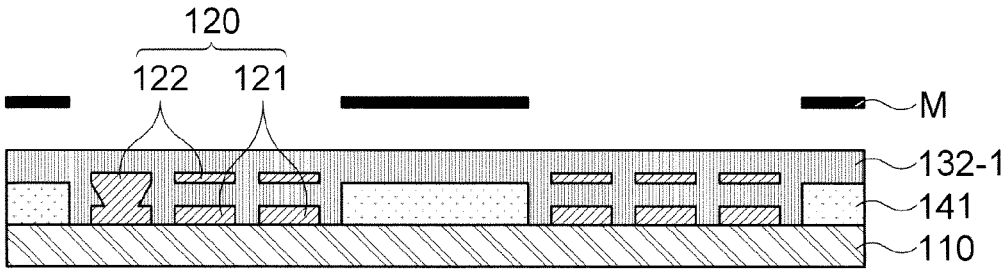
Figure 4J:
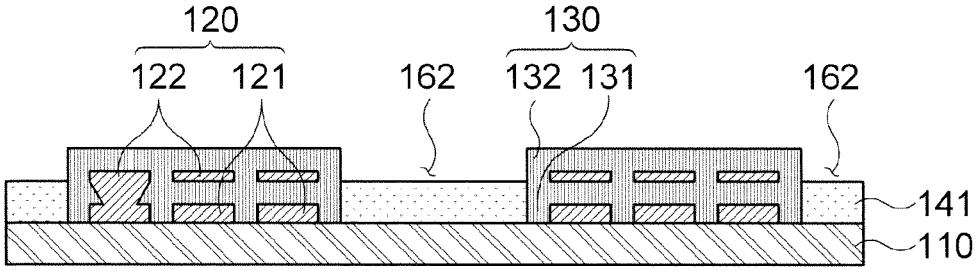

Next, as shown in FIGS. 4*i* and 4*j*, a second insulating portion 132 is formed by removing the region of the second insulating layer 132-1 except the region in which the second wiring pattern 122 is formed.

Figure 4K:
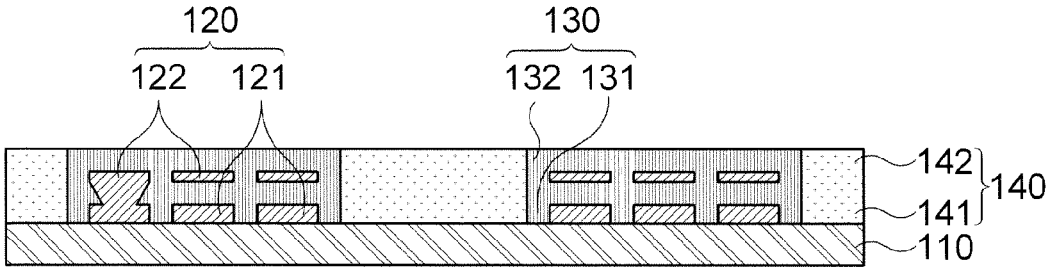

Next, as shown in FIG. 4*k*, a second metal-polymer composite 142 is filled in the region 162 except the second insulating portion 132.

Meanwhile, although not shown, the wiring pattern 120 may be formed of more than three layers by repeating the processes shown in FIGS. 4*g* to 4*k* after forming the via hole 135 in the second insulating portion 132.

Figure 5A:
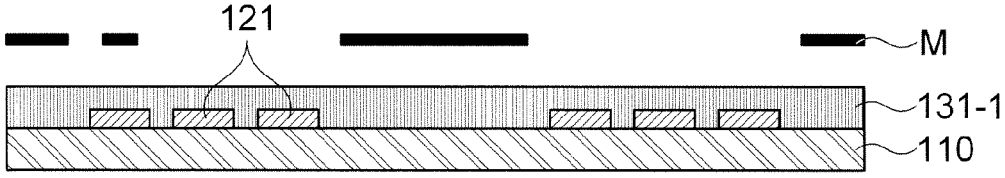
FIGS. 5*a* and 5*b* are views schematically showing a method for manufacturing a chip inductor in accordance with a modified embodiment of the present invention.
Figure 5B:
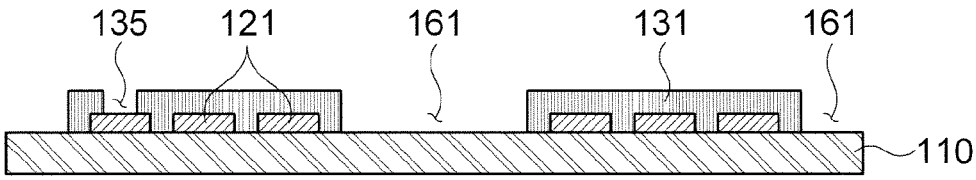

FIGS. 5*a* and 5*b* are views schematically showing a method for manufacturing a chip inductor 100 and 200 in accordance with a modified embodiment of the present invention.

Referring to FIGS. 5*a* and 5*b*, a method of forming a via hole 135 is different from that in the above-described embodiment, and a method for manufacturing a chip inductor 100 and 120 in accordance with a modified embodiment of the present invention will be described by centering around a difference.

Referring to FIG. 5*a*, in order to form a via hole 135, which exposes an upper surface of a portion of a first wiring pattern 121, a mask M, which exposes a region of a first insulating layer 131-1 in which the first wiring pattern 121 is formed, may prevent light from reaching a portion in which the via hole 135 is to be formed.

Next, referring to FIG. 5*b*, the region of the first insulating layer 131-1 except the region in which the first wiring pattern 121 is formed is removed, and in this process, the via hole 135 can be formed.

Since the remaining matters are almost the same as those in the description referring to FIG. 4, repeated description will be omitted.

Meanwhile, as in this modified embodiment, when filling the first metal-polymer composite 141 after forming the via hole 135, a separate means may be applied to prevent the first metal-polymer composite 141 from being introduced into the via hole 135.

FIGS. 6*a* to 6*h* are views schematically showing a method for manufacturing a chip inductor 100 and 200 in accordance with another embodiment of the present invention.

Hereinafter, a method for manufacturing a chip inductor 100 and 200 in accordance with another embodiment of the present invention will be described in detail with reference to FIGS. 6*a* to 6*h*.

A method for manufacturing a chip inductor 100 and 200 in accordance with another embodiment of the present invention can manufacture a chip inductor 100 by forming an insulating portion 130 after repeating a process of forming a wiring pattern 120, a process of forming an insulating layer 131-1, and a process of forming a via hole 135 more than twice and filling a metal-polymer composite 140 in the region except the insulating portion 130.

Figure 6A:
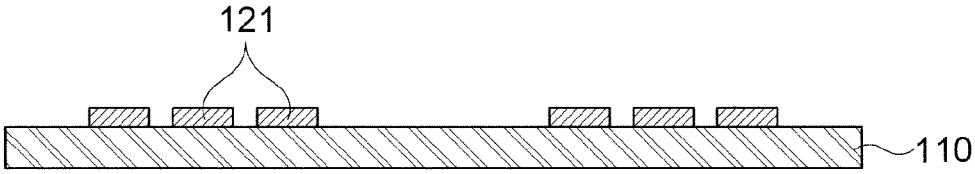
FIGS. 6*a* to 6*h* are views schematically showing a method for manufacturing a chip inductor in accordance with another embodiment of the present invention.

First, referring to FIG. 6*a*, the process of forming the wiring pattern 120 may be performed by forming a first wiring pattern 121 on one surface of a base substrate 110. At this time, the first wiring pattern 121 may be formed by printing or plating.

Figure 6B:
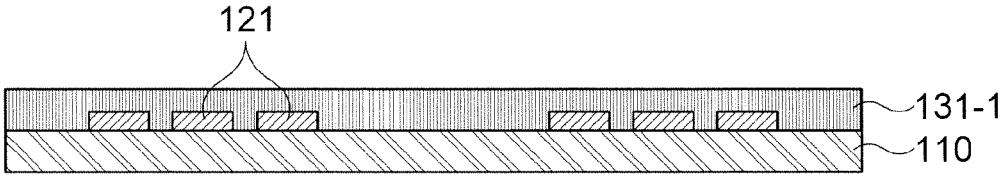

Next, as shown in FIG. 6*b*, the first insulating layer 131-1 is formed. The first insulating layer 131-1 may be formed by coating an insulating material on the base substrate 110 on which the first wiring pattern 121 is formed.

Figure 6C:
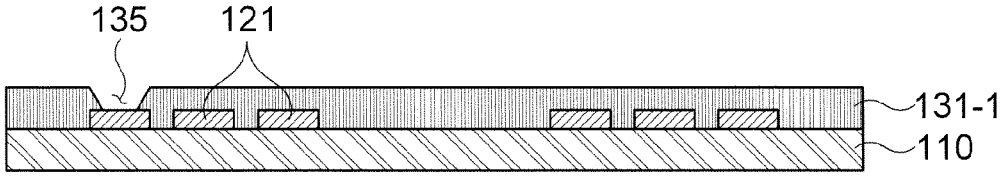

Next, as shown in FIG. 6*c*, the via hole 135 is formed in the first insulating layer 131-1. At this time, the via hole 135 may be formed by various methods such as an etching method using $CO_2$ laser.

Figure 6D:
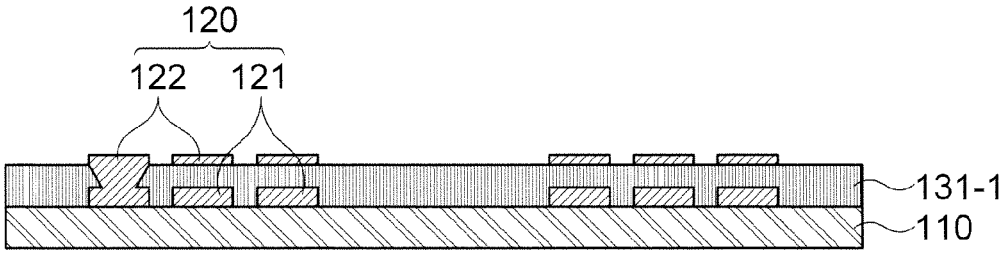

Next, as shown in FIG. 6*d*, a second wiring pattern 122 is formed on an upper surface of the first insulating layer 131-1. At this time, the first wiring pattern 121 and the second wiring pattern 122 can be electrically connected by filling a conductive material for forming the second wiring pattern 122 in the via hole 135 formed in the first insulating layer 131-1.

Figure 6E:
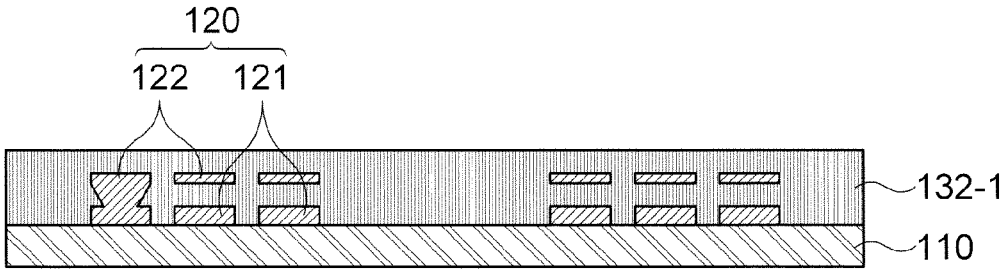

Next, as shown in FIG. 6*e*, a second insulating layer 132-1 is formed to cover surfaces of the second wiring pattern 122 and the first insulating layer 131-1.

Figure 6F:
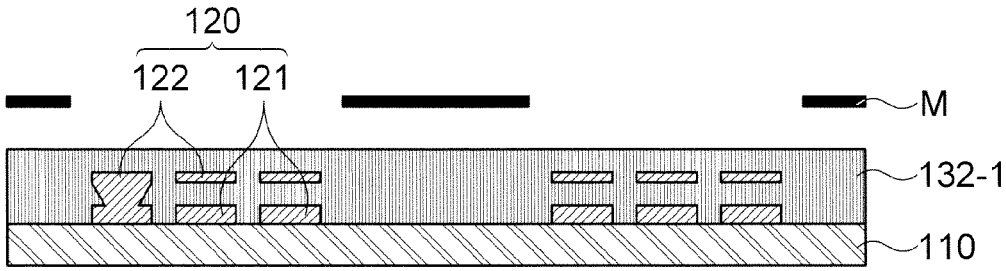
Figure 6G:
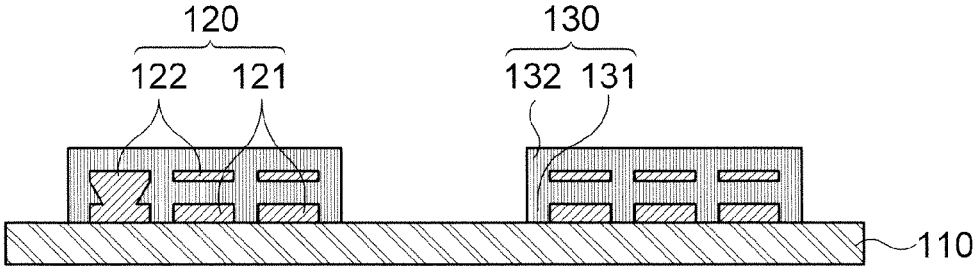

Next, as shown in FIGS. 6*f* and 6*g*, an insulating portion 130 is formed by removing the regions of the first insulating layer 131-1 and the second insulating layer 132-1 except the regions in which the first wiring pattern 121 and the second wiring pattern 122 are formed.

Figure 6H:
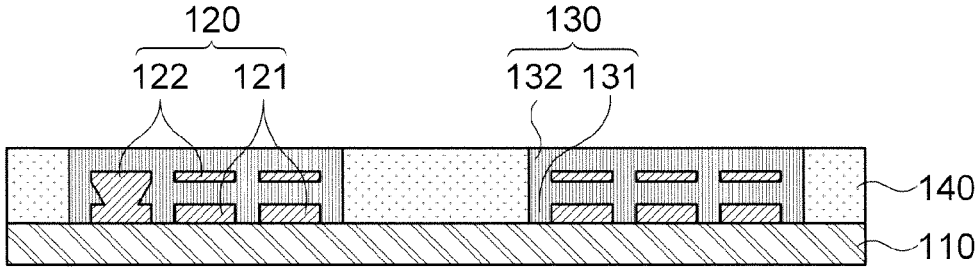

Next, as shown in FIG. 6*h*, the metal-polymer composite 140 is filled in the region except the insulating portion 130.

Meanwhile, although not shown, the wiring pattern 120 may be formed of more than three layers by repeating the above-described processes.

The present invention configured as above provides a useful effect of implementing a chip inductor that overcomes magnetic saturation as well as implementing high inductance while reducing DC resistance.

Further, the present invention provides a useful effect of reducing process costs and improving manufacturing efficiency by mass-producing the above chip inductor in a lower temperature environment than before.

The foregoing description illustrates the present invention. Additionally, the foregoing description shows and explains only the preferred embodiments of the present invention, but it is to be understood that the present invention is capable of use in various other combinations, modifications, and environments and is capable of changes and modifications within the scope of the inventive concept as expressed herein, commensurate with the above teachings and/or the skill or knowledge of the related art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A chip inductor comprising:

a metal-polymer composite in which metal particles and polymer are mixed;

a wiring pattern provided inside the metal-polymer composite to form a coil;

an external electrode provided in a portion of an outer peripheral surface of the metal-polymer composite; and an insulating portion provided between the metal-polymer composite and the wiring pattern and between the metal-polymer composite and the external electrode, wherein at least a portion of the metal-polymer composite is disposed between the wiring pattern and the external electrode.

2. The chip inductor according to claim 1, wherein the polymer comprises at least one material selected from epoxy, polyimide, and liquid crystal polymer (LCP).

3. The chip inductor according to claim 1, wherein the metal particles comprise iron (Fe).

4. The chip inductor according to claim 1, wherein the metal-polymer composite, the wiring pattern, the external electrode, and the insulating portion are disposed such that a planar cross-section across the chip inductor sequentially passes through the external electrode, the insulating portion, the metal-polymer composite, a first portion, the metal-polymer composite, a second portion, the metal-polymer composite, the insulating portion, and the external electrode where the planar cross-section passing through the first portion and the second portion each comprise the planar cross-section sequentially passing through a first insulating portion, a wiring pattern, and a second insulating portion.

5. The chip inductor according to claim 1, wherein a diameter of the metal particles is in the range of several hundreds of nm to several tens of μm.

6. The chip inductor according to claim 1, wherein the wiring pattern is formed of a plurality of layers.

7. The chip inductor according to claim 6, wherein winding is performed more than twice on one layer of the wiring pattern.

8. A chip inductor comprising:

a base substrate;

a wiring pattern provided on an upper surface of the base substrate to form a coil;

a metal-polymer composite provided on the upper surface of the base substrate and formed by mixing metal particles and polymer;

an external electrode provided in portions of outer peripheral surfaces of the base substrate and the metal-polymer composite; and an insulating portion provided between the metal-polymer composite and the wiring pattern and between the metal-polymer composite and the external electrode, wherein at least a portion of the metal-polymer composite is disposed between the wiring pattern and the external electrode.

9. The chip inductor according to claim 1, wherein the metal-polymer composite is not disposed between adjacent windings of the coil.

10. The chip inductor according to claim 1, wherein the insulating portion provides electrical insulation between the metal-polymer composite and the wiring pattern and between the metal-polymer composite and the external electrode.

11. The chip inductor according to claim 8, wherein the metal-polymer composite is not disposed between adjacent windings of the coil.

12. The chip inductor according to claim 8, wherein the insulating portion provides electrical insulation between the metal-polymer composite and the wiring pattern and between the metal-polymer composite and the external electrode.

* * * * *